US006256995B1

(12) United States Patent
Sampath et al.

(10) Patent No.: US 6,256,995 B1
(45) Date of Patent: Jul. 10, 2001

(54) SIMPLE LOW COST FUEL NOZZLE SUPPORT

(75) Inventors: Parthasarathy Sampath, Mississauga; Richard Alan Kostka, Maple, both of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/450,634

(22) Filed: Nov. 29, 1999

(51) Int. Cl.[7] ..... F02C 1/00
(52) U.S. Cl. ..... 60/740
(58) Field of Search ..... 60/740

(56) References Cited

U.S. PATENT DOCUMENTS

| | | | |
|---|---|---|---|
| 2,690,648 | 10/1954 | Pearce et al. . | |
| 3,684,186 | 8/1972 | Helmrich . | |
| 3,912,164 | 10/1975 | Lefebvre et al. . | |
| 4,216,652 | 8/1980 | Herman et al. . | |
| 4,491,272 | 1/1985 | Bradley et al. . | |
| 4,735,044 | 4/1988 | Richey et al. . | |
| 4,763,481 | 8/1988 | Cannon . | |
| 4,854,127 | 8/1989 | Vinson et al. . | |
| 4,890,453 | 1/1990 | Iwai et al. . | |
| 4,938,418 | 7/1990 | Halvorsen . | |
| 5,127,346 | 7/1992 | Kepplinger et al. . | |
| 5,161,379 | 11/1992 | Jones et al. . | |
| 5,222,357 | 6/1993 | Eddy et al. . | |
| 5,288,021 | 2/1994 | Sood et al. . | |
| 5,423,178 | 6/1995 | Mains . | |
| 5,577,386 | 11/1996 | Alary et al. . | |
| 5,579,645 | 12/1996 | Prociw et al. . | |
| 5,598,696 * | 2/1997 | Scotts | 60/39.02 |
| 6,003,781 * | 12/1999 | Kwan | 239/132.3 |
| 6,076,356 * | 6/2000 | Pelletier | 60/740 |

FOREIGN PATENT DOCUMENTS

| | | |
|---|---|---|
| 493434 | 11/1938 | (GB) . |
| 2038473 | 7/1980 | (GB) . |

* cited by examiner

*Primary Examiner*—Charles G. Freay
*Assistant Examiner*—Eric D. Hayes
(74) *Attorney, Agent, or Firm*—Jeffrey W. Astle

(57) ABSTRACT

The invention relates to a simple low cost fuel nozzle support stem that can be manufactured to meet extremely close tolerances with enhanced structural rigidity through use of a cylindrical stem body machined from solid bar stock. Superior thermal control to regulate thermal displacement of the stem body and to prevent fuel coking is provided by a concentric secondary fuel bore and a primary fuel tube disposed within the bore. The low pressure secondary fuel flow encircles the high pressure primary flow tube and serves to cool the fuel tube and cylindrical stem body in a uniform symmetric manner. An outer cylindrical insulating sleeve mounted on shoulders extending from the cylindrical body of the stem defines an elongate annular insulating air gap between the sleeve and cylindrical stem body. The support stem includes a dual fuel spray nozzle and a fuel adapter/mounting flange that are mounted to the stem body with simple cylindrical sockets. Therefore, the support stem has a modular construction based on a simple cylindrical easily machined stem body with concentric primary and secondary fuel channels, a fuel adapter/mounting flange with cylindrical socket brazed to an outer end of the stem body, and a replaceable nozzle with cylindrical socket brazed to an inner end of the stem body.

13 Claims, 2 Drawing Sheets

SIMPLE LOW COST FUEL NOZZLE SUPPORT

TECHNICAL FIELD

The invention relates to a simple low cost fuel nozzle support stem that can be manufactured to meet extremely close tolerances with enhanced structural rigidity and thermal stability through use of concentric dual fuel channels within a simple cylindrical stem body machined from solid bar stock.

BACKGROUND OF THE ART

Gas turbine engines conventionally include several fuel nozzles to spray fuel into the combustors. Generally the nozzles are mounted to a wall of the engine housing and are spaced circumferentially apart around the periphery of the combustor to dispense the fuel in a generally circumferential pattern.

Since the fuel nozzles and their support stems are located in a very hot area of the engine, the fuel passing through the support stem can rise to a temperature sufficient to decompose or carbonise the fuel resulting in coking that can clog the nozzles and prevent the nozzles from spraying fuel properly into the combustor. Therefore, fuel nozzle support stems are generally constructed with some form of insulation and fuel cooling system to prevent the fuel from heating to a temperature, which would produce coke. In operating conditions where nozzle stems conduct a low volume of fuel or fuel flow becomes stagnant, the fuel can become heated during a long residence time in the hot combustor environment. An insulating sleeve of sheet metal is generally used to provide an insulating air gap that partially shields the nozzle stem from excess heating. Various methods are also conventionally used to circulate relatively cool fuel through the nozzle support stem in order to provide a flow of cooling liquid to regulate the temperature of the stem and control heat transfer to fuel flowing through the stem.

A common cooling system utilised for dual fuel nozzles is where a primary fuel tube and a secondary fuel tube are concentrically disposed within the support stem so as to define two distinct conduits for directing primary and secondary fuel flows. The primary fuel is conveyed through a conduit of circular cross section defined by the primary fuel tube while the secondary fuel is delivered through the annular space defined between the primary fuel tube and the secondary fuel tube.

U.S. Pat. No. 4,735,044 to Richie et al. shows a dual fuel path stem with an inner primary fuel tube and outer tube housed within a hollow tubular stem. All three components are concentric and bent to a desired configuration during manufacture. A distinct disadvantage of the bent tube stem is that accurate positioning of the nozzles becomes extremely difficult. The tubes tend to straighten or deform in a heated environment such that the nozzle tip is displaced as a result of thermal expansion. This thermally induced movement is substantially worsened where the structure is asymmetric or where the cooling is unbalanced. Such displacements in the location of the nozzle tip can significantly effect performance, emissions and reliability of the combustion system.

A further example of concentric tube construction is shown in U.S. Pat. No. 5,577,386 to Alary et al. The manufacture of such concentric tubes to accurate dimensions is very difficult. In addition, due to the complex shape of the stem structure and use of thin walled tubes, the thermal deformation in a heated environment is difficult to predict.

As a result of the combined inaccuracy from manufacture and heat distortion, the precise location and orientation of the fuel nozzles is below the standards required for aircraft engine manufacture. Tolerances for the position and orientation of fuel nozzles are becoming very stringent as a result of a drive to improve the fuel efficiency, to reduce environmental pollution in operation of gas turbine engines, and to ensure that the flow requirements to the turbine sections of the engine are maintained.

Fuel nozzles and their support stems are conventionally constructed of thin wall tubes in order to minimise aircraft engine weight. However, as mentioned above, the bending of concentric thin wall tubes during manufacture is a difficult procedure to perform accurately especially where extremely close tolerances are essential. In addition, thin wall tubes even if equipped with insulating air gap sleeves or circulating fuel-cooling systems nevertheless experience significant distortion in an extremely hostile high temperature-high turbulence environment. This in turn results in deterioration in combustor performance and increased exhaust emissions.

On the other hand, since nozzles must be frequently serviced and the fuel conduits within the support stems often accumulate coke, these engine components are frequently replaced during overhaul of an engine. As a result any significant increase in the cost of manufacturing nozzles and fuel stems to more precise tolerances multiplies the increase in the cost of overhauls and engine maintenance.

It is an object of the invention to provide a nozzle support stem structure which can be easily machined and assembled to extremely close manufacturing tolerances with improved structural strength and dynamic stability to improve engine fuel efficiency, emissions and operability through accurate orientation and location of fuel nozzles.

It is an object of the present invention to provide a low cost easily manufactured and maintained nozzle support stem which incorporates a dual fuel cooling system to prevent fuel coking and to minimise the effects of heat distortion.

It is a further object of the invention to provide a nozzle support stem structure assembled from modular components to reduce manufacturing costs, and engine overhaul costs.

Further objects of the invention will be apparent from review of the drawings and description of the invention below.

DISCLOSURE OF THE INVENTION

The invention relates to a simple low cost fuel nozzle support stem that can be manufactured to meet extremely close tolerances with enhanced structural rigidity through use of a cylindrical stem body machined from solid bar stock, thus ensuring accurate alignment of nozzles to combustor for maximum performance with reduced engine emissions.

The thick walls of the stem are accurately machined from solid bar stock resulting in a relatively heavy stem compared to the prior art but with superior structural strength and greater dynamic stability thus ensuring accurate nozzle alignment.

Superior thermal control regulates thermal displacement of the stem body and prevents fuel coking with a concentric secondary fuel bore and a primary fuel tube disposed within the bore. The low pressure secondary fuel flow encircles the high pressure primary flow tube and serves to cool the fuel tube and cylindrical stem body in a uniform symmetric manner.

An outer cylindrical insulating sleeve mounted on shoulders extending from the cylindrical body of the stem defines an elongate annular insulating air gap between the sleeve and cylindrical stem body. The support stem includes a dual fuel spray nozzle and a fuel adapter/mounting flange that are mounted to the stem body with simple cylindrical sockets.

Therefore, the support stem has a modular construction based on a simple cylindrical easily machined stem body with thick walls, concentric primary and secondary fuel channels, a fuel adapter/mounting flange with cylindrical socket brazed to an outer end of the stem body, and a replaceable nozzle with cylindrical socket brazed to an inner end of the stem body.

Since nozzles and support stems are often serviced during the engine overhauls, the simple design of the invention results in significant manufacturing cost savings. The invention provides improved nozzle positioning accuracy in operation, with respect to the engine combustor, due to the superior accuracy of a solid machined stem body compared to prior art bent tubes. The solid machined stem body with concentric thick walled stem, and dual nested fuel flow channels also improves thermodynamic performance to prevent non-uniform thermal expansion and the resulting distortion of the nozzle.

The substantially cylindrical stem body is easily machined from solid bar stock to a high degree of precision. Conventional thin walled concentric tubular stem bodies have a much lower weight, which generally have a significant advantage in air craft engine design. However, due to the improved accuracy of nozzle location, improved structural/dynamic strength and improved resistance to heat deformation, the relatively thick walled rigid stem body of the invention with modestly increased weight can be justified.

When compared to a manufacturing procedure which bends a series of concentric tubes, the machining of a solid bar into a rigid thick wall tubular stem body results in a higher degree of dimensional accuracy.

When compared with a thin wall bent tube, the rigid thick wall stem body of the invention with concentric internal fuel passages provides a much improved cooling which results in dimensional stability under operating conditions. The relatively large thermally conductive mass of solid metal material forming the body stem better dissipates localised heat and dampens the effect of rapid changes in the temperature of the surrounding environment. As well, the machined body stem can be designed for various modular fuel adapter assemblies and uniform modular nozzles.

The cylindrical stem with concentric fuel channels provides symmetric radial cooling of the body stem with relatively large thermally conductive metal mass. The mass of the stem provides a thermal buffer for more uniform and predictable thermal expansion/contraction compared with relatively thin wall bent tubes of the prior art.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
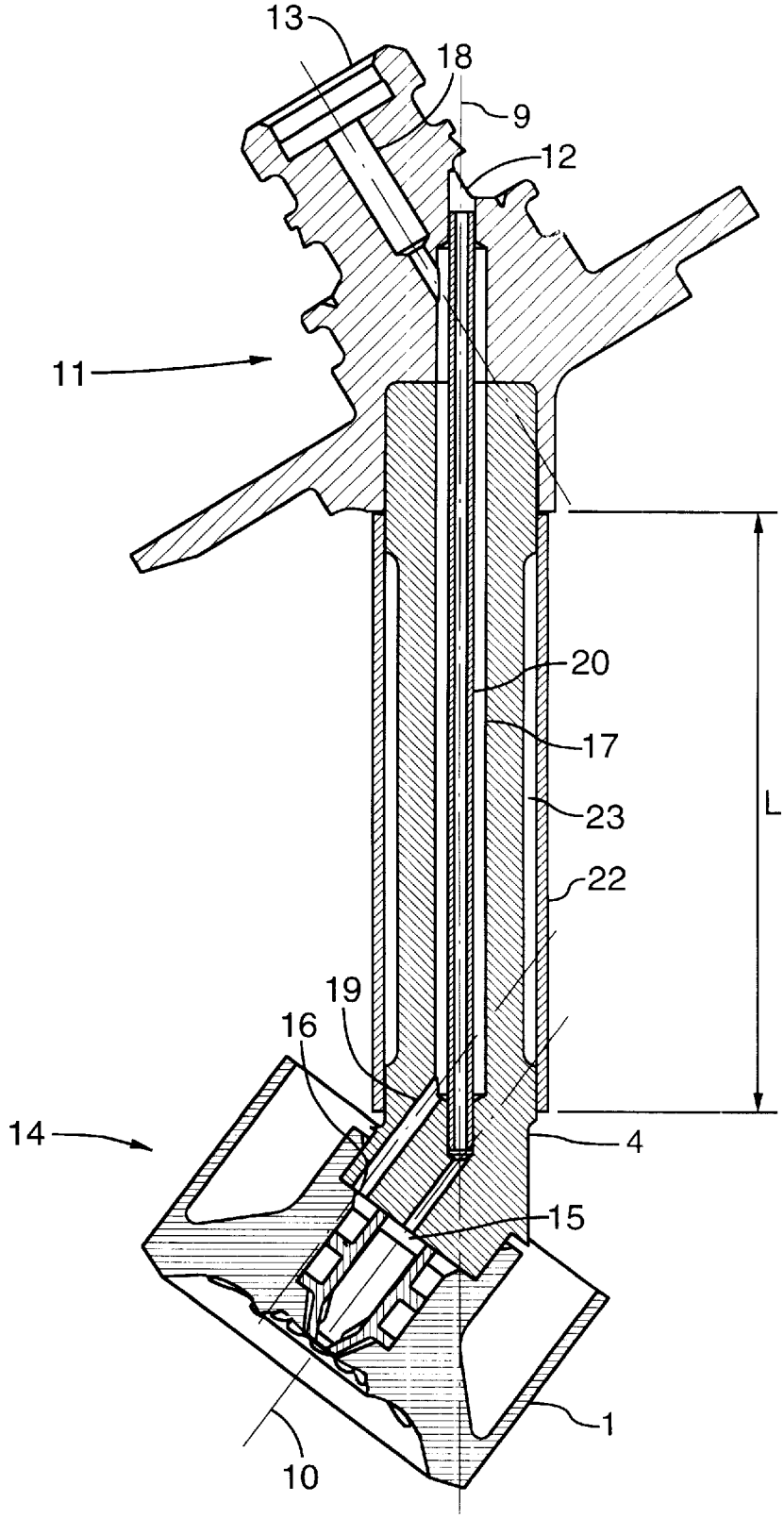
FIG. 1 shows a longitudinal sectional view through the fuel nozzle support stem with modular dual fuel nozzle and fuel adapter/mounting flange components brazed in cylindrical sockets to opposite ends of the stem body, and the body including concentric bore with primary fuel tube and outer insulating sleeve.
Figure 2:
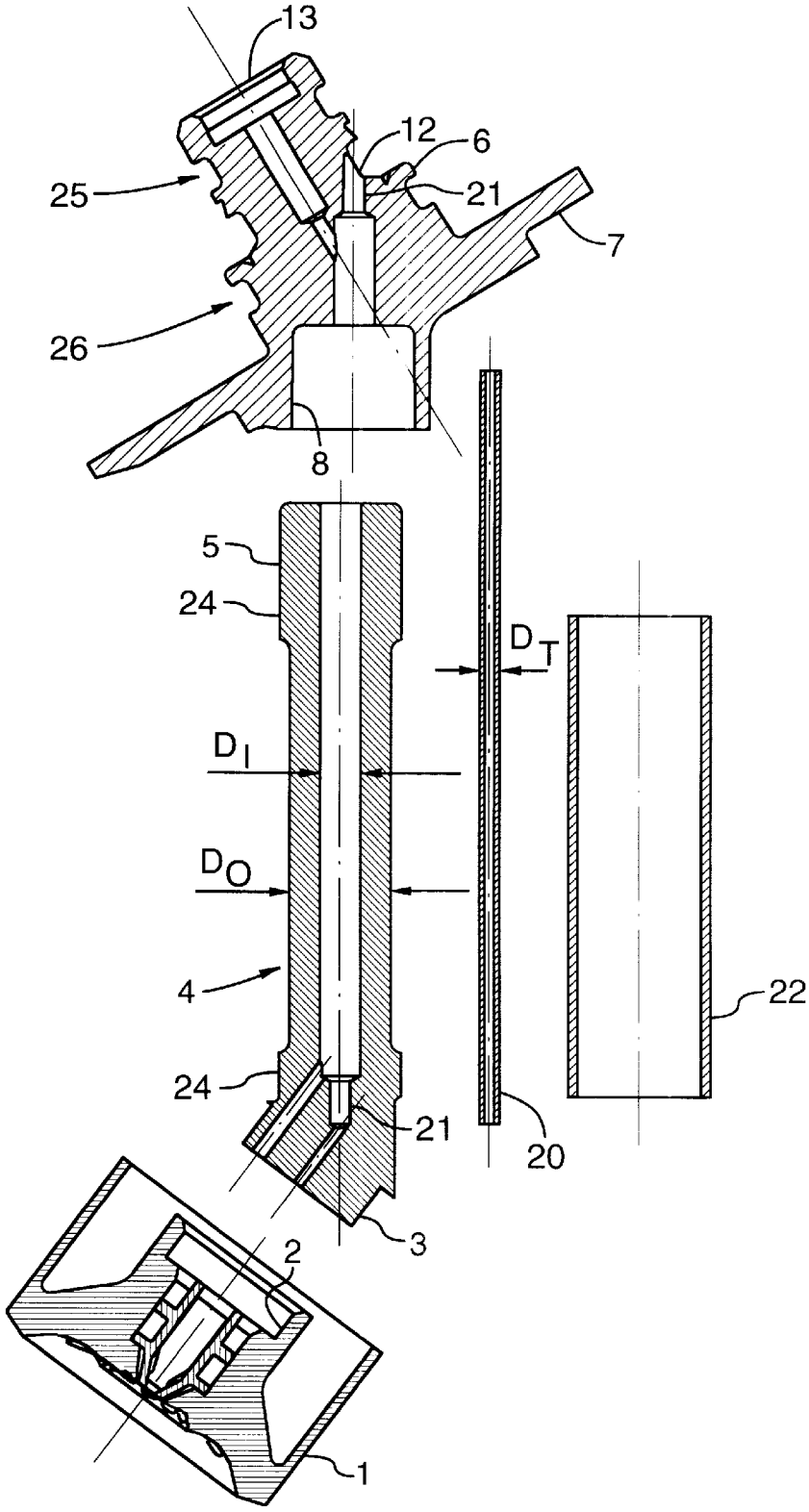
FIG. 2 is an exploded longitudinal sectional view showing the separate modular components of the fuel nozzle support stem.

Referring to FIGS. 1 and 2, the invention provides a fuel nozzle support stem for a gas turbine engine, which has a high degree of modularity and can be easily manufactured as indicated in FIG. 2. The dual fuel spray nozzle assembly 1 is often replaced during engine overhaul or fuel nozzle reconditioning. The nozzle 1 includes a cylindrical nozzle-mounting socket 2 within which a cylindrical inner end 3 of the stem body 4 is mounted and brazed.

In a like manner, at the outer end 5, also cylindrical, a fuel adapter 6 with a base mounting flange 7 can be standardised as a module for different engine configurations. The fuel adapter 6 also includes a cylindrical stem body-mounting socket 8 within which the outer end 5 of the stem body 4 is mounted and brazed in place.

Therefore, it can be seen that by utilising standard nozzles 1 and fuel adapters 6, various lengths of stem bodies 4 and angular orientations of the nozzle 1 can be easily accommodated.

The assembled fuel nozzle support stem shown in FIG. 1 has a longitudinal axis 9 and the nozzle 1 has a nozzle axis 10 disposed at an obtuse angle relative to the stem axis 9. It will be apparent that any angular orientation can be provided by appropriate machining of the stem 4. Typical angular orientations would range between 90° and 180°. Conventional numerical controlled machining stations can quickly turn the cylindrical stem body 4 and configure the angular orientation of inner end 3 at a much reduced cost compared to forming and bending concentric tubes as in the prior art discussed above.

The stem body 4 itself has an elongate substantially cylindrical body symmetric about the axis 9 and having an outer diameter $D_O$. The inlet end 11 of the fuel nozzle support stem includes a primary fuel inlet port 12 and a secondary fuel inlet port 13. The outlet end 14 of the fuel nozzle support stem 4 includes a primary fuel outlet port 15 and a secondary fuel outlet port 16. Centred along the longitudinal axis 9, the stem body 4 has a concentric longitudinal secondary fuel bore 17 with an inner diameter $D_I$ which communicates between the secondary inlet port 13 and the secondary outlet port 16 via lateral takeoff bores 18 and 19. The lateral orientation of these bores 18 and 19 tends to swirl the secondary fuel flow about the concentric primary fuel tube 20.

The primary fuel tube 20 is disposed within the bore 17 and it is sealed by brazing to the inlet end 11 and the outlet end 14 of the support stem and communicates between the primary inlet port 12 and the primary outlet port 15. The bore 17 includes concentric end steps 21 at each extreme ends of the bore 17 to mate with the outer diameter $D_T$ of the primary fuel tube 20.

In order to provide structural rigidity and to distribute and dissipate thermal energy between the cooling flow within the bore 17 and the external surfaces of the stem body 4, the walls of the cylindrical stem body 4 are relatively thick where $D_O$ is greater than $2D_I$ and where the cantilever length L of the stem is limited to L less than 20 times the wall thickness or $10(D_0-D_I)$. Through calculation of the structural and dynamic stability these proportions have been determined as the practical limitations on the cylindrical thick walled stem body 4 that produce the desired accuracy of nozzle positioning. The ranges of dimensional proportions may vary within these ranges depending on the relative mass of the nozzle assembly and materials used, however, by ensuring that the cylindrical walls are thick enough relative to the length, to satisfy the proportions stated above, the designer can be certain of producing from solid stock a nozzle stem of superior accuracy and with improved radially symmetric cooling. The proportional limits on the dimensions of the stem body 4 limit the slenderness of this structural component within bounds that ensure the positioning accuracy of the nozzle 1. The increased strength and stiffness resulting from the exterior sleeve 22 and interior tube 20 adds a further degree of accuracy, and each concentric component (4, 20, 22) should have a compatible co-efficient of thermal expansion to act in a composite manner.

In these proportions, the greater structural rigidity of the stem body 4 and resulting dynamic stability are much improved over the relatively thin wall bent tubes of the prior art. As well, thermal energy is better distributed by the relatively large thermal mass and is better cooled symmetrically with the concentric fuel channel of the stem body 4 as opposed to a relatively thin wall tube.

An outer cylindrical insulating sleeve 22 is disposed outwardly a distance from the cylindrical body of the stem 4 thereby defining an elongate annular insulating air gap 23 between the sleeve 22 and body 4. Preferably, for ease of machining and assembly, the outer end 5 and inner end 3 of the stem 4 each include a cylindrical shoulder 24 which extends radially outward from the stem body 4 and is assembled within the sleeve 22. In the drawings, the cantilever length L of the stem is substantially equal to the length of the sleeve 22. The fuel adapter 6 and flange 7 serve to rigidly connect the body 4 to the engine, and the inner end 3 with nozzle 1 is free to float as the stem body 4 reacts to thermal, structural and dynamic stresses.

The fuel adapter 6 includes a primary fuel connector 25 with circumferential groove for a sealing o-ring and a secondary fuel connector 26 also with sealing o-ring circumferential groove thereby to provide fuel system access to the primary fuel inlet 12 and secondary fuel inlet 13 respectively.

As can be seen clearly in FIG. 2, the invention provides a means to simplify fuel nozzle support stem design and produce modular units that can be adapted for any conventional engine design. The relative lengths of the stem body 4, primary fuel tube 20 and insulating sleeve 22 can be modified for any length of support stem desired, without modifying the standardised modular fuel adapter 6 and the standard modular nozzle 1.

In addition, through machining of the stem body 4 accuracy of nozzle orientation and location can be significantly improved over the bent tubular support stems of the prior art. Any angular orientation can be machined with equal precision and little difficulty. As a result, the positioning of the nozzle 1 and angular orientation can be rapidly modified merely by changing the lengths of the primary fuel tube 20 and insulating sleeve 22 in conjunction with modified machining of stem body 4. An extremely rigid accurate and inexpensive fuel nozzle support stem can be provided in accordance with the invention.

Although the above description relates to a specific preferred embodiment as presently contemplated by the inventor, it will be understood that the invention in its broad aspect includes mechanical and functional equivalents of the elements described.

We claim:

1. A fuel nozzle support stem for delivering a primary liquid fuel and a secondary liquid fuel to be mixed with compressed air in the combustor of a gas turbine engine, the stem having: a longitudinal axis; an elongate substantially cylindrical body symmetric about the axis and having an outer diameter $D_0$ and length L; an inlet end with primary and secondary liquid fuel inlet ports; and an outlet end with primary and secondary liquid fuel outlet ports, the support stem having a concentric longitudinal secondary liquid fuel bore having an inner diameter $D_I$ and communicating between the secondary inlet port and the secondary outlet port, and a concentric primary liquid fuel tube disposed within the bore, sealed to the inlet and outlet ends of the support stem and communicating between the primary inlet port and the primary outlet port; wherein $D_0$ is greater than $2D_I$, and L is less than $10(D_0-D_I)$.

2. A stem according to claim 1 wherein the bore includes concentric end steps at extreme ends of the bore mating an outer diameter $D_T$ of the primary fuel tube.

3. A stem according to claim 1 including an outer cylindrical insulating sleeve disposed outwardly a distance from the cylindrical body of the stem thus defining an elongate annular insulating air gap between the sleeve and body.

4. A stem according to claim 3 wherein the inlet and outlet ends each include a cylindrical shoulder extending radially outward from the stem body and disposed within the sleeve.

5. A stem according to claim 1 wherein the inlet end includes a liquid fuel adapter with primary and secondary fuel system sealing connectors.

6. A stem according to claim 1 wherein the inlet end includes a base mounting flange.

7. A stem according to claim 1 wherein the outlet end includes a dual liquid fuel spray nozzle assembly.

8. A stem according to claim 7 wherein the nozzle assembly has a nozzle axis disposed at an angle relative to the longitudinal axis of the stem.

9. A stem according to claim 8 wherein said angle is obtuse.

10. A fuel nozzle support stem for delivering a primary liquid fuel and a secondary liquid fuel to be mixed with compressed air in the combustor of a gas turbine engine, the stem having: a longitudinal axis; an elongate substantially cylindrical body symmetric about the axis and having an outer diameter $D_0$ and length L; an inlet end with primary and secondary liquid fuel inlet ports; and an outlet end with primary and secondary liquid fuel outlet ports, the support stem having a concentric longitudinal secondary liquid fuel bore having an inner diameter $D_I$ and communicating between the secondary inlet port and the secondary outlet port, and a concentric primary liquid fuel tube disposed within the bore, sealed to the inlet and outlet ends of the support stem and communicating between the primary inlet port and the primary outlet port; wherein $D_0$ is greater than $2D_I$, and L is less than $10(D_0-D_I)$;

an outer cylindrical insulating sleeve disposed outwardly a distance from the cylindrical body of the stem thus defining an elongate annular insulating air gap between the sleeve and body, the inlet and outlet ends of the stem body each including a cylindrical shoulder extending radially outward from the stem body and disposed within the sleeve;

the inlet end including a liquid fuel adapter having primary and secondary fuel system sealing connectors, and having a stem body mounting socket within which an outer end of the stem body is mounted; and the outlet end including a dual liquid fuel spray nozzle assembly with a nozzle axis disposed at an obtuse angle relative to the longitudinal axis of the stem.

11. A stem according to claim 10 wherein the stem body mounting socket and the stem body outer end are cylindrical.

12. A stem according to claim 10 wherein the spray nozzle includes a nozzle mounting socket within which an inner end of the stem body is mounted.

13. A stem according to claim 12 wherein the nozzle mounting socket and the stem body inner end are cylindrical.

* * * * *